US005527042A

United States Patent [19]

Spriddle

[11] Patent Number: 5,527,042

[45] Date of Patent: Jun. 18, 1996

[54] INCLINING GOLF PRACTICE PLATFORM PIVOTABLE BY USER'S WEIGHT

[76] Inventor: Dean N. Spriddle, #503 - 4691 West 10th Avenue, Vancouver, B.C., Canada, V6R 2J3

[21] Appl. No.: 170,957

[22] Filed: Dec. 21, 1993

[51] Int. Cl.[6] ..... A63B 69/36

[52] U.S. Cl. ..... 473/279

[58] Field of Search ..... 273/195 B

[56] References Cited

U.S. PATENT DOCUMENTS

| | | | |
|---|---|---|---|
| 2,591,051 | 4/1952 | Caldwell | 248/188.5 X |
| 2,879,996 | 3/1959 | Lederer | 273/195 B X |
| 2,908,472 | 10/1959 | McDonald | 248/649 X |
| 2,956,761 | 10/1960 | Weber | 248/188.3 X |
| 3,281,101 | 10/1966 | May | 248/188.3 X |
| 3,516,513 | 6/1970 | Robertson | 248/188.3 X |
| 3,633,917 | 1/1972 | Anderson | 273/195 B |
| 3,633,918 | 1/1972 | Smiley et al. | 273/195 B |
| 3,869,127 | 3/1975 | Kohori | 273/195 B |
| 4,613,133 | 9/1986 | Selberg et al. | 273/195 B |
| 4,875,684 | 10/1989 | Benilan | 273/195 B |
| 5,005,837 | 4/1991 | Martinez | 273/195 B |
| 5,114,327 | 5/1992 | Williamson | 425/139 |
| 5,183,449 | 2/1993 | DeCloux | 482/53 |
| 5,340,111 | 8/1994 | Froelich | 273/195 B |

FOREIGN PATENT DOCUMENTS 2238250 11/1989 United Kingdom .

*Primary Examiner*—William H. Grieb
*Attorney, Agent, or Firm*—Bereskin & Parr

[57] ABSTRACT

A practice platform is provided for use by a golfer to practice swinging a club on different inclines. The practice platform has a deck pivotally mounted to a base. Unlike known prior practice golf platforms, the deck is intended to be pivoted to different inclines solely by the golfer's positioning himself upon the deck so that his weight causes the deck to pivot, without the use of a power drive mechanism. The platform includes a mechanism to hold the deck in the selected position, and also to facilitate positioning of the deck by restricting it from pivoting freely through its full range of motion in reaction to the golfer's weight.

20 Claims, 3 Drawing Sheets

INCLINING GOLF PRACTICE PLATFORM PIVOTABLE BY USER'S WEIGHT

FIELD OF THE INVENTION

This invention relates to devices of the type used to assist golfers in practicing their golf swing. In particular, the invention relates to a platform having a deck whose angle of inclination may be altered in order for a golfer to practice his swing in uphill, downhill or sidehill ball placement situations.

BACKGROUND OF THE INVENTION

Since the game of golf is played on an uneven playing field, it is common for golfers to be presented with a ball position on sloping terrain. Under the rules of golf, the ball must be hit from where it lies. Accordingly, being able to hit a ball cleanly and accurately from an inclined or uneven position is an important skill necessary in order to excel at the game.

To increase their skill at hitting a golf ball, golfers often practice their swing by hitting balls at a practice or driving range. Since hitting a golf ball accurately from an inclined slope is generally considered one of the more difficult golf shots, many golfers also wish to practice their swing on inclined surfaces. Unfortunately, most commercial facilities which provide golfers with areas to practice provide only level or flat practice surfaces.

Various attempts have been made to provide practice platforms that simulate uneven or inclined terrain. Numerous such devices having a base and an inclined deck have been developed for this purpose. Although the known devices take various shapes and forms, they all essentially comprise an inclined deck providing a surface upon which a golfer may practice his swing with some form of power drive means, connected to an external source of power, used to position and reposition the platform in different attitudes and thereby enable a golfer to practice his swing on varying degrees and orientations of inclination.

The inherent problems or limitations of the known inclining practice platforms revolves around their use of power drive means and external power sources. Because they utilize such drive means and power sources, their internal mechanisms tend to include complex mechanical and electrical components. As a result they suffer from the disadvantages of high cost, susceptibility to breakdown, high maintenance, and a need for a readily available external power source. Where such devices are used in an outdoor environment, moreover, their electrical components must be shielded from exposure to water and moisture, and they are also susceptible to corrosion and malfunction. Furthermore, many of these prior devices lack a means to lock the platform in position, or where such a locking mechanism is present it is dependant upon the external power source for its functioning.

SUMMARY OF THE INVENTION

Accordingly, the present invention provides a practice platform for use by a golfer to practice swinging a club on different inclines, comprising a base, a deck pivotally mounted to the base and pivotable to different inclines solely by a golfer positioning himself thereupon so that his weight causes the deck to pivot, without the use of power drive means, and releasable holding means to prevent the deck from pivoting further once it has been pivoted to a selected incline regardless of the subsequent repositioning of the golfer upon the deck.

Preferably, the practice platform further comprises means to moderate the speed at which the deck is pivotable on the base in reaction to the golfer's weight.

Advantageously, the practice platform includes at least one fluid activated cylinder connected from the base to the deck and having a fluid line extending therefrom and also valve means to control the flow of fluid through the cylinder, the valve means having an open position permitting operation of the cylinder and thereby permitting pivotal movement of the deck relative to the base in reaction to the golfer's weight, and having a closed position preventing operation of the cylinder and thereby preventing pivotal movement of the deck relative to the base. More advantageously, the cylinder has two fluid containing chambers separated by a piston and has two fluid lines, one connecting to each chamber, and the fluid lines connect to each other in a closed loop.

Most preferably, the deck is mounted to the base by means of a universal joint allowing multi-directional pivoting of the deck relative to the base, and the practice platform includes two fluid activated cylinders for controlling pivoting of the deck on the base in generally orthogonal directions of inclination.

It has surprisingly been found that while hitherto known inclining practice platforms all include some form of power drive means, utilization of the golfer's own weight can achieve the same result without the complexity and cost of power drive means.

Other objects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show a preferred embodiment of the present invention in which.

DESCRIPTION OF THE PREFERRED EMBODIMENT

Figure 1:
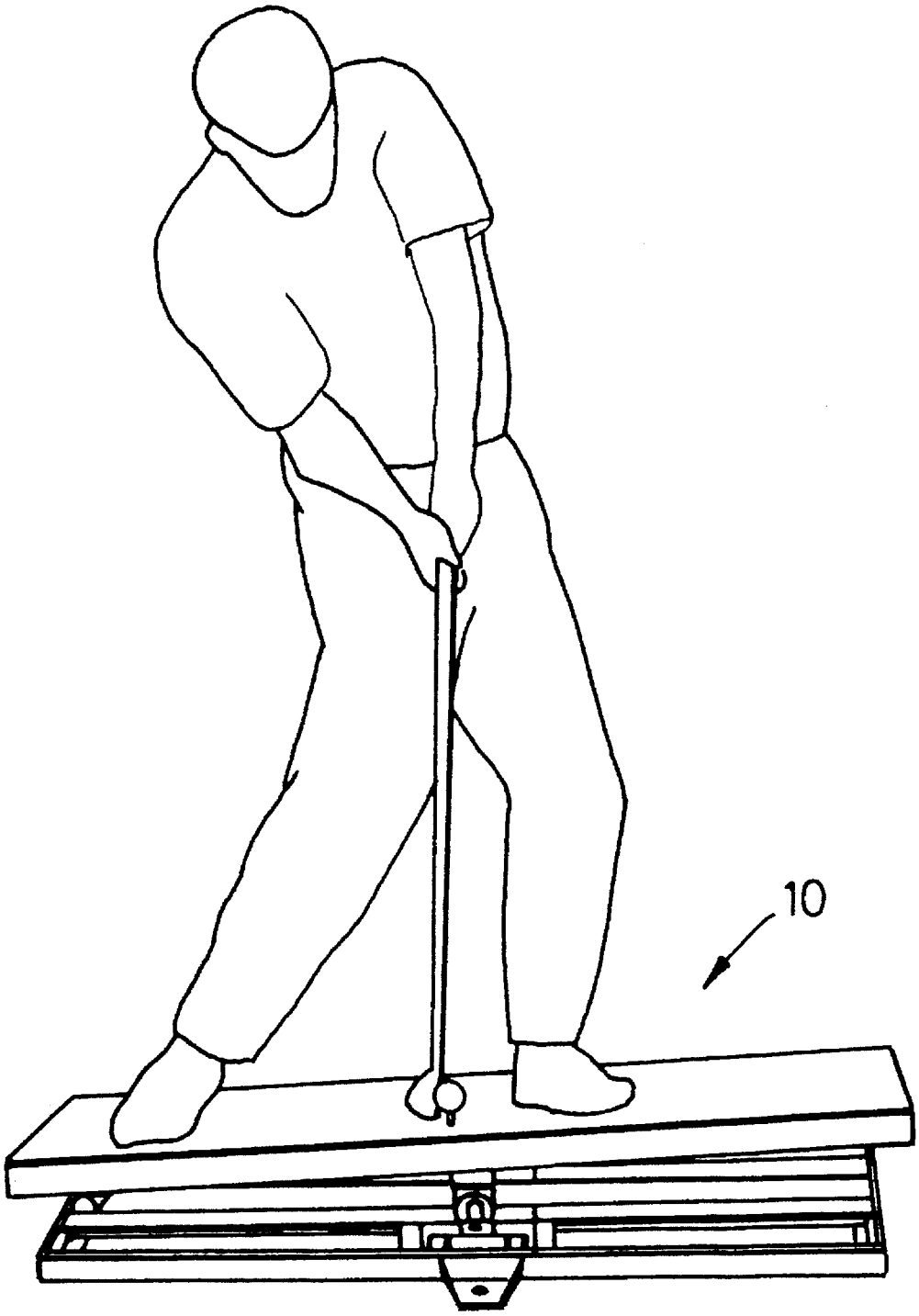
FIG. 1 is a side perspective view from above of a practice platform of the present invention, showing a typical positioning of a golfer upon it.
Figure 2:
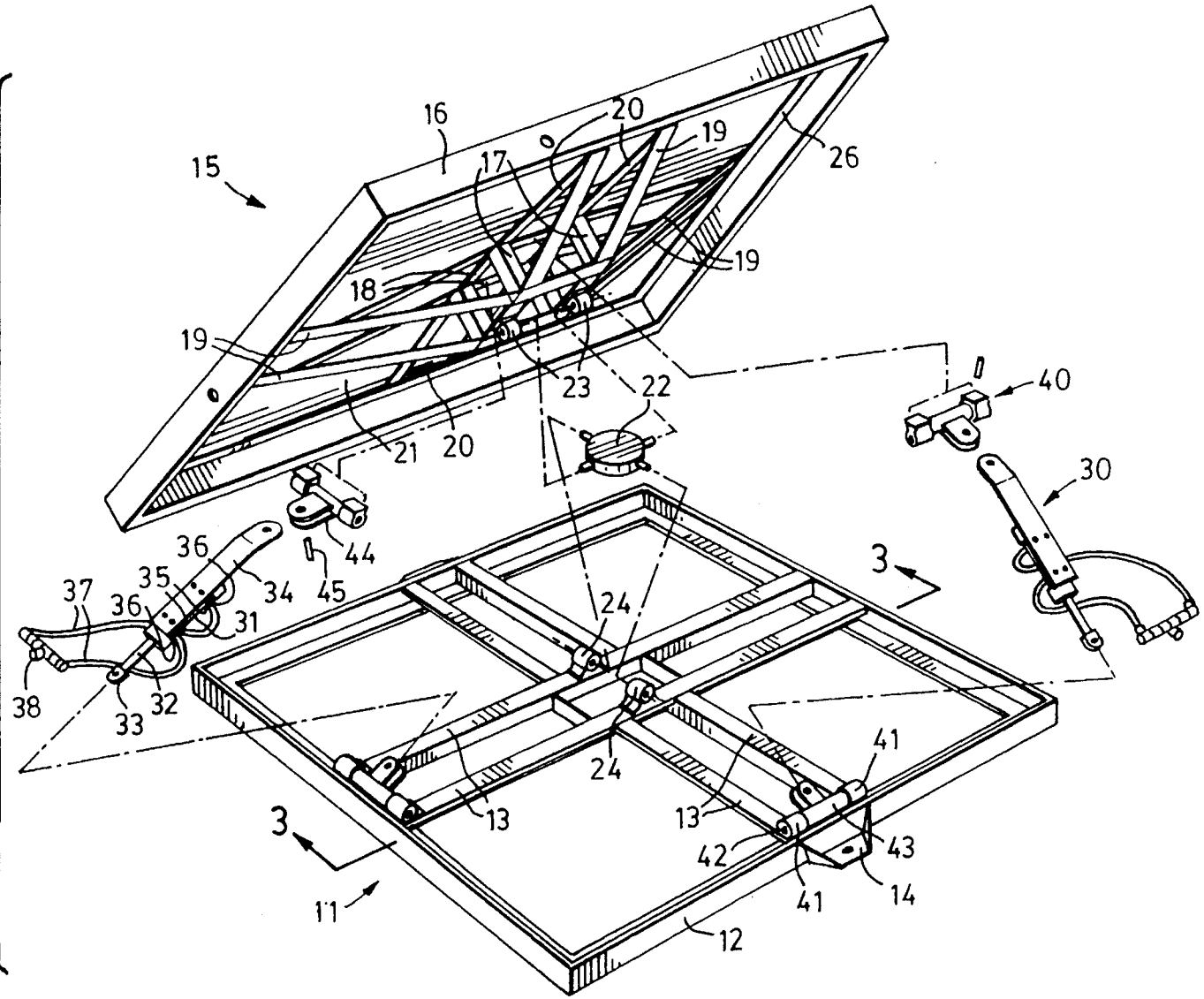
FIG. 2 is an exploded oblique perspective view of the practice platform of FIG. 1.
Figure 5:
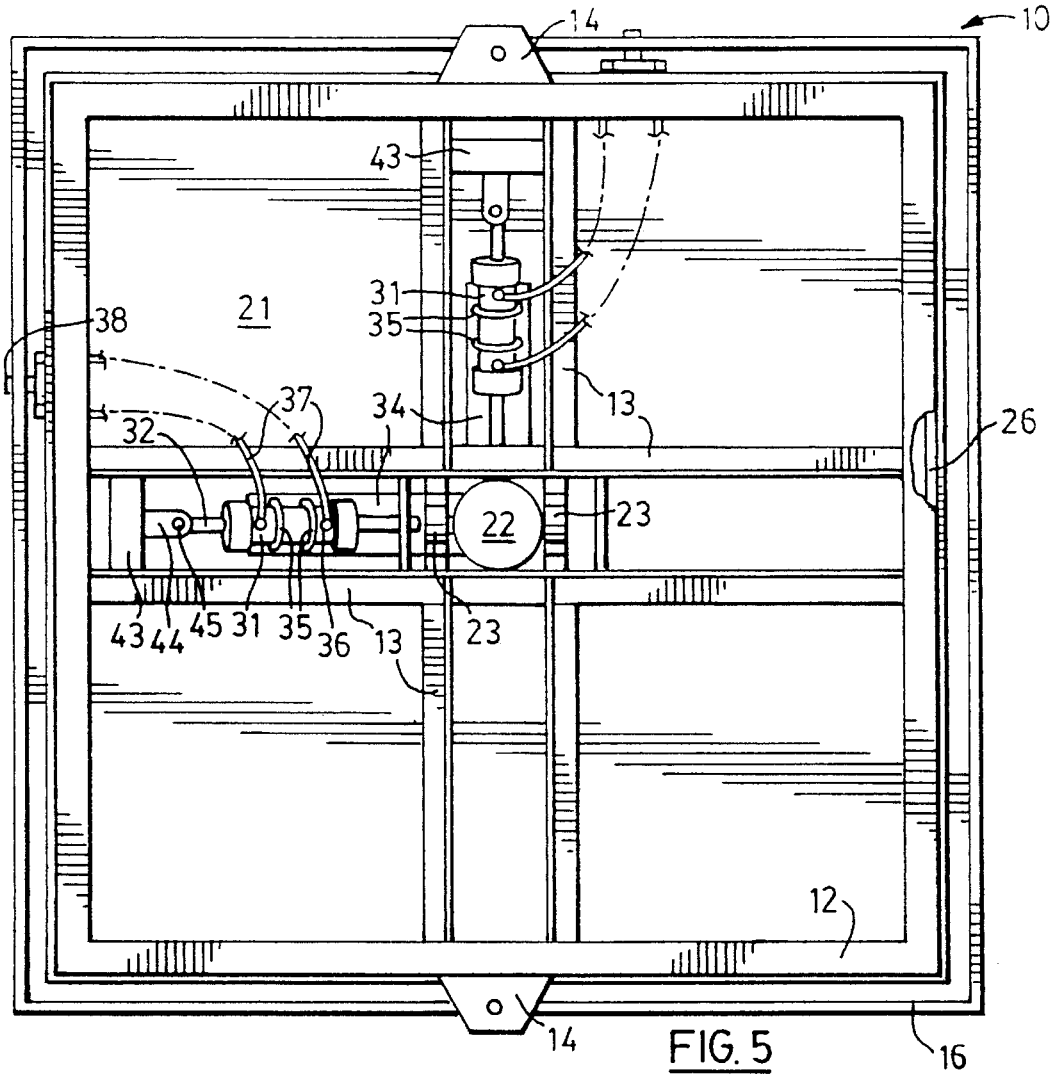
FIG. 5 is a bottom view of the practice platform FIG. 3 in the direction shown by the arrows of line 5—5, omitting the deck's supporting truss network for ease of understanding.
Figure 3:
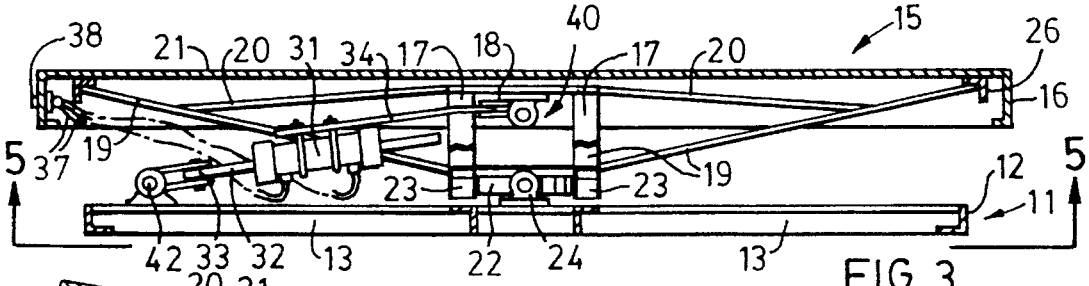
FIG. 3 is a cross-sectional elevation view of the practice platform of FIG. 2 taken along the line 3—3 in the direction of the arrows, with the deck in a horizontal position.
Figure 4:
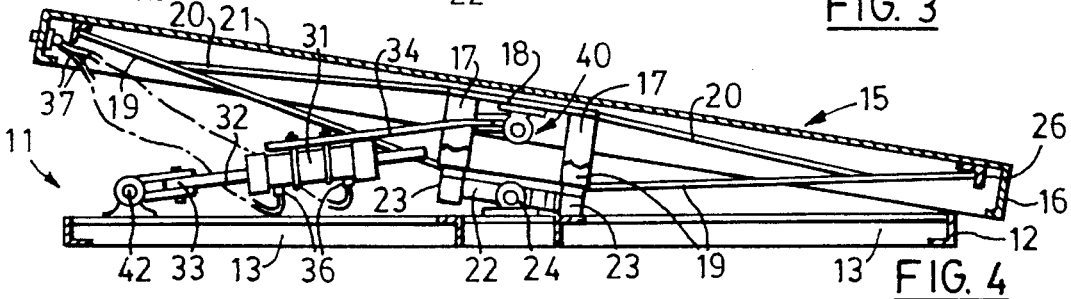
FIG. 4 is the same cross-sectional elevation view of the practice platform of FIG. 3, with the deck re-oriented in an inclined position.

Referring first to FIG. 1, the practice platform, designated generally by reference numeral 10, is intended to be placed upon the ground so that a golfer can place himself upon it to practice his golf swing, as shown.

Turning to FIGS. 2–5, the practice platform 10 comprises a base 11 and a deck 15 which is mounted to the base 11 by means of a universal joint assembly and a pair of hydraulic cylinders 30. The base comprises a base frame 12 and cross members 13 which extend across the sides of the frame 12. A pair of lugs 14 extend outwardly from two opposite sides of the base frame 12 and provide means for securing the base 11 to the ground.

The deck 15 comprises an upper portion and a supporting truss network. The upper portion includes sides 16 and floor 21. The truss network comprises four parallel spaced posts 17 held together at their tops and bottoms with braces 18 to form a box-like structure. Eight struts 19 extend from the bottom of the posts 14 to a deck frame 26 that runs along the bottom of the floor 21 close to the sides 16. Ties 20 extend from the tops of the posts 17 to connect with the struts 19.

The deck 15 is mounted to the base 11 by means of a universal joint assembly comprising a plate 22 from which extend four pivot pins 23 radiating outwardly and aligned in two orthogonal pairs. One pair of pivot pins 23 is journaled in a pair of bushings 24 mounted to two cross members 13 of the base 11. The other pair of pivot pins 23 is journaled within another pair of bushings 25 mounted on two braces 18 of the deck 15, the second pair of bushings 25 being oriented in a plane that is generally orthogonal to the first set of bushings 24.

This universal joint assembly provides for independent pivoting of the pivot pins 23 within the first set of bushings 24 and the pivot pins 23 within the second set of bushings 25, thereby permitting the deck 15 to be inclined in any direction relative to the base 11.

A pair of hydraulic cylinders 30 extend between the base 11 and the deck 15 held by upper and lower cylinder connectors 40, which are mounted to two orthogonal braces 18 and corresponding orthogonal side members of the frame 12, respectively.

Each of the hydraulic cylinders 30 comprises a housing 31 and a piston rod 32 which extends slidingly through hydraulically sealed orifices at either end of the housing 31 and which comprises a piston extending across the interior of the housing that divides the housing into upper and lower chambers, whose sizes vary with the position of the piston rod.

The lower end of the piston rod 32 merges to a blade 33. A bar 34 is secured to the housing 31 by means of U-bolts 35 and extends upwardly beyond the housing 31 and beyond the upper end of the piston rod 32.

Upper and lower hose lines 37 connect to upper and lower ports 36, respectively, and thereby communicate with the upper and lower chambers within the housing. The upper and lower hose lines 37 also connect to a valve 38, and thereby establish a closed loop.

When the valve 38 is in its closed position, hydraulic fluid within the closed loop cannot flow, and therefore the piston rod 32 resists any displacement within the housing 31. When the valve 38 is in its open position, hydraulic fluid within the closed loop can flow, and therefore the piston rod 32 can slide within the housing 31.

Each of the upper and lower cylinder connectors 40 comprises a pair of rings 41 holding a shaft 42 upon which is pivotally secured a sleeve 43. A pair of leaves 44 extend outwardly from the sleeve 43. The leaves 44 of the upper connector 40 receive between them the upper end of the extension bar 34 which is pivotally connected thereto by means of a pin 45 that extends through aligned holes in the extension bar 34 and the leaves 44. The leaves 44 of the lower connector 40 receive between them the blade 33 which is pivotally connected thereto by means of another pin 45 that extends through aligned holes in the blade 33 and the leaves 44. The upper and lower connectors 40 thereby permit the hydraulic cylinders 30 to hinge upwardly and downwardly and also to pivot laterally from side to side.

The sides of the base frame 12 and the cross members 13 are made of steel angle, and are welded together. The posts 17 and deck frame 26 members are made of steel angle, and the braces 18, struts 19, and ties 20 are all made of steel flat bar, welded to each other and the posts 17 and the deck frame 26. The floor 21 and sides 16 are made of light gauge aluminium plate. The floor 21 is braised and bolted to the deck frame 26. A cover of synthetic turf material is applied adhesively to the top of the floor 21.

In use, a golfer steps onto the floor of the deck portion of the platform. If the golfer wants to change the angle or orientation of the incline of the deck, he positions himself on that part of the floor that he wants to move downwardly. He then opens the valves, which are normally biased to a closed position. When the valves are opened, hydraulic fluid is permitted to flow through the closed loops and the deck moves under the weight of the golfer.

The speed at which the deck moves is limited by the flow of the hydraulic fluid. Thus, the sizes of the cylinder housing, and of the hoses and the valves, are selected to prevent the deck from moving so fast that maneuvering it would be difficult or so fast that a significant shock would be encountered by the golfer when movement of the deck ceased. The sizes of the cylinder housing, hoses and valves are also selected though to permit the deck to move quickly enough so as not to cause undue delay in changing the inclination of the deck.

When the deck has been moved to the desired new inclination, the golfer closes the valves to prevent further flow of hydraulic fluid in the closed loops. The deck thus stops moving any further, and it remains in the selected inclination regardless of where the golfer subsequently repositions himself.

It will of course be appreciated that numerous alternatives and other embodiments are possible within the broad scope of the invention. For example, while the embodiment described above and shown in the drawings has manual valves with switches located on the sides of the deck, an alternative would be to have a remote control device for opening and closing the valves which the golfer could access without having to bend down.

In the embodiment described above and shown in the drawings the hydraulic cylinders have upper and lower hydraulic chambers and the hose lines connect from both chambers to a valve, and thereby establish a closed loop. The piston rods of such cylinders provide pressurized releasable holding in two directions. In an alternative embodiment, hydraulic cylinders having a single hydraulic chamber, thus providing pressurized releasable holding in one direction only, could be used in pairs, on opposing sides of the mounting assembly, to provide releasable holding of the deck in either direction. In such an embodiment, hose lines would extend from the single hydraulic chamber of each cylinder to the valve. Opening of the valve would permit flow of hydraulic fluid from the cylinder on one side to the cylinder on the other side.

In the embodiment described above and shown in the drawings the hydraulic cylinders are mounted to the deck near the center of the floor. In an alternative embodiment, the hydraulic cylinders could be mounted to the deck near the sides, and thus be in a substantially upstanding orientation rather than an inclined orientation. However, having the cylinders in an inclined orientation reduces the total height of the platform.

Two hydraulic cylinders are used in the embodiment described above and shown in the drawings to control adjustment of the inclination of the deck in all directions. In alternative embodiments three or more hydraulic cylinders could be employed.

Alternatively, if adjustment of the inclination of the deck is desired in a single direction only, for example, for practicing of straight uphill and downhill lies, the deck could be mounted to the base with a hinging assembly, rather than a universal joint assembly, and in such a case a single hydraulic cylinder would be sufficient to control inclination of the deck in the direction of pivoting permitted by the hinging assembly. In yet another modification, such a mounting could be used with a single hydraulic cylinder to provide different inclinations of the practice platform in all directions by incorporating a turn-table mechanism as part of the base.

One or more hydraulic cylinders are a feature of preferred embodiments of the present invention. However, other means for releasably locking the deck in a desired inclination and means for restricting the speed of movement of the deck under a golfer's weight when released may be substituted. For example, pneumatic cylinders could be used rather than hydraulic cylinders. Moreover, mechanical devices, such as ratchet and pawl mechanisms and so forth could be used with appropriate modifications; mechanisms that permit releasable holding in one direction only could be used in pairs, on opposing sides of the mounting assembly, to provide releasable holding of the deck in either direction.

Other materials of construction may also be substituted. For example, high strength plastic could be used for components of the base and deck.

Thus, in its broadest scope, the present invention provides many modifications and alternative embodiments, appropriate for different circumstances.

I claim:

1. A practice platform for use by a golfer to practice swinging a club on different inclines, comprising:

a base;

a deck, pivotally mounted to said base, pivotable to different inclines solely by such a golfer's positioning himself thereupon so that his weight causes said deck to pivot without the use of power drive means;

releasable holding means to prevent said deck from pivoting further once it has been pivoted to a selected incline regardless of the subsequent repositioning of the golfer upon said deck;

control means for activating and releasing said releasable holding means;

means for restricting said deck from pivoting freely through its full range of motion in reaction to the golfer's weight when said holding means is released, without manipulation of said control means.

2. The practice platform of claim 1 further comprising means for moderating the speed at which said deck is pivotable on said base in reaction to the golfer's weight.

3. The practice platform of claim 2 wherein said releasable holding means and said speed control means include at least one fluid activated cylinder having a housing connected to one of said base and said deck and having a piston rod connected to the other of said base and said deck and having fluid lines communicating in a closed loop extending therefrom.

4. The practice platform of claim 3 wherein said control means includes valve means to control the flow of fluid through said cylinder, said valve means having an open position permitting operation of said cylinder thereby permitting pivotal movement of said deck relative to said base, and a closed position preventing operation of said cylinder and thereby preventing pivotal movement of said deck relative to said base.

5. The practice platform of claim 4 wherein the flow of fluid through said closed loop and said cylinder is restricted, thereby moderating the speed at which said deck is pivotable on said base in reaction to the golfer's weight upon said deck.

6. The practice platform of claim 5, wherein said deck is mounted to said base by universal joint means allowing multi-directional pivoting of said deck relative to said base.

7. The practice platform of claim 6 wherein said universal joint means of said deck to said base comprises two orthogonal pivots.

8. The practice platform of claim 7 having at least two fluid activated cylinders, with at least one of said cylinders being situated generally perpendicular to the axis of each of said two orthogonal pivots.

9. The practice platform of claim 8 wherein said fluid activated cylinders are hydraulic.

10. A practice platform for use by a golfer to practice swinging a club on different inclines, comprising:

a base;

a deck, pivotally mounted to said base; and hydraulic means for releasably holding said deck at different inclines, including at least one hydraulic cylinder connected to said deck, and at least one valve means for controlling the flow of hydraulic fluid through said hydraulic cylinder;

said deck being pivotable to different inclines with said valve means in an open position solely by the golfer's positioning himself thereupon so that his weight causes said deck to pivot without the use of power drive means, and said deck being prevented from pivoting when said valve means is in a closed position regardless of where the golfer positions himself thereupon.

11. The practice platform of claim 10, wherein said deck is mounted to said base by universal joint means allowing multi-directional pivoting of said deck relative to said base.

12. The practice platform of claim 11, having at least two hydraulic cylinders situated for releasably holding said deck at different inclines in multi-directional pivoting of said deck relative to said base.

13. The practice platform of claim 12 wherein said hydraulic cylinder has a housing connected to one of said base and said deck and has a piston rod connected to the other of said base and said deck, said piston rod including a piston dividing said cylinder into upper and lower hydraulic chambers, and said hydraulic cylinder has fluid lines communicating in a closed loop extending from said upper and lower hydraulic chambers.

14. The practice platform of claim 13 wherein the flow of fluid through said closed loop and said hydraulic cylinder is restricted, thereby moderating the speed at which said deck is pivotable on said base in reaction to the golfer's weight upon said deck.

15. The practice platform of claim 14, having two hydraulic cylinders situated for controlling pivoting of the deck on the base in generally orthogonal directions of inclination.

16. A practice platform for use by a golfer to practice swinging a club on different inclines, comprising:

a base;

a deck, pivotally mounted to said base, pivotable to different inclines solely by such a golfer's positioning himself thereupon so that his weight causes said deck to pivot without the use of power drive means;

releasable holding means permitting said deck to be so pivoted while released, and while activated preventing said deck from pivoting further regardless of the subsequent repositioning of the golfer upon said deck;

control means for activating and releasing said releasable holding means; and means, independent of said control means, for restricting said deck from pivoting freely through its full range of motion in reaction to the golfer's weight when said holding means is released.

17. The practice platform of claim 16 further comprising means for moderating the speed at which said deck is pivotable on said base in reaction to the golfer's weight.

18. The practice platform of claim 17 wherein said releasable holding means and said speed control means include at least one fluid activated cylinder having a housing connected to one of said base and said deck and having a piston rod connected to the other of said base and said deck and having fluid lines communicating in a closed loop extending therefrom.

19. The practice platform of claim 18 wherein said control means includes valve means to control the flow of fluid through said cylinder, said valve means having an open position permitting operation of said cylinder thereby permitting pivotal movement of said deck relative to said base, and a closed position preventing operation of said cylinder and thereby preventing pivotal movement of said deck relative to said base.

20. The practice platform of claim 19 wherein the flow of fluid through said closed loop and said cylinder is restricted, thereby moderating the speed at which said deck is pivotable on said base in reaction to the golfer's weight upon said deck.

* * * * *